US006519559B1

(12) United States Patent
Sirivara

(10) Patent No.: US 6,519,559 B1
(45) Date of Patent: Feb. 11, 2003

(54) APPARATUS AND METHOD FOR THE ENHANCEMENT OF SIGNALS

(75) Inventor: Sudheer Sirivara, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/363,478

(22) Filed: Jul. 29, 1999

(51) Int. Cl.[7] ..... G10L 21/02
(52) U.S. Cl. ..... 704/227
(58) Field of Search ..... 704/227, 226

(56) References Cited

U.S. PATENT DOCUMENTS

| | | | | | |
|---|---|---|---|---|---|
| 4,627,091 | A | * | 12/1986 | Fedele | 704/233 |
| 4,912,766 | A | * | 3/1990 | Forse | 704/225 |
| 5,416,887 | A | | 5/1995 | Shimada | 704/233 |
| 5,485,522 | A | | 1/1996 | Solve et al. | 381/56 |
| 5,633,936 | A | | 5/1997 | Oh | 381/66 |
| 5,712,953 | A | * | 1/1998 | Langs | 704/214 |
| 5,781,883 | A | * | 7/1998 | Wynn | 704/226 |
| 6,230,123 | B1 | * | 5/2001 | Mekuria et al. | 704/226 |

OTHER PUBLICATIONS

Cappe, Olivier, "Elimination of the Musical Noise Phenomenon with the Ephraim and Malah Noise Suppressor," IEEE Trans. Speech and Audio Proc., vol. 2, Apr. 1994, pp. 345–349.*

* cited by examiner

*Primary Examiner*—Marsha D. Banks-Harold
*Assistant Examiner*—Donald L. Storm
(74) *Attorney, Agent, or Firm*—Schwegman, Lundberg, Woessner & Kluth, P.A.

(57) ABSTRACT

A signal processing unit is disclosed for selectively routing an unfiltered input signal and a noise reduced version of the unfiltered input signal to an output port in response to a noise power estimate. Routing the unfiltered input signal to the output port when the noise power estimate is less than a noise floor threshold avoids degrading the information content of an input signal having a power level close to the noise floor. A first attenuation factor and a second attenuation factor can be applied to the unfiltered input signal. A method is disclosed for parsing a signal into a plurality of frames, selecting a maximum value for each frame, and averaging the maximum values to form a noise floor threshold.

13 Claims, 6 Drawing Sheets

APPARATUS AND METHOD FOR THE ENHANCEMENT OF SIGNALS

FIELD

The present invention relates to signal processing, and more particularly, to the processing of signals in the presence of noise.

BACKGROUND

Signal processing applications often process a signal of interest corrupted with noise. Since noise limits the ability of a circuit or other signal processing system to transmit faithfully the information carried by the signal of interest, it is often desirable to reduce the noise level in a noise corrupted signal.

Filtering is one method of reducing the noise level in a noise corrupted signal. In filtering, the passband of a filter is designed to pass the frequencies associated with the signal of interest and to block or reduce the frequencies not associated with the signal of interest. Unfortunately, noise often contains the same frequencies as the frequencies contained in the signal of interest. In that case, filtering a noise corrupted signal may also distort the signal of interest.

Spectral gain modification is another method of reducing the noise level in a noise corrupted input signal. In applying spectral gain modification to a noise corrupted input signal, the noise corrupted signal is divided into spectral bands, and each spectral band is attenuated according to its signal-to-noise ratio. A spectral band having a high signal-to-noise ratio is attenuated by a small attenuation factor. A spectral band having a low signal-to-noise ratio is attenuated by a large attenuation factor. The spectral bands are then recombined to produce a noise-suppressed output signal. Unfortunately, when spectral gain modification is applied to speech signals, an unwanted side effect occurs. Watery or musical noise, which is characterized by unwanted isolated tones in the speech spectrum, is introduced into the output signal.

For these and other reasons there is a need for the present invention.

SUMMARY

A system comprises a signal processing unit. The signal processing unit is operable for selectively routing an input signal and a noise reduced version of the input signal to an output port in response to a noise power estimate.

DETAILED DESCRIPTION

Figure 1:
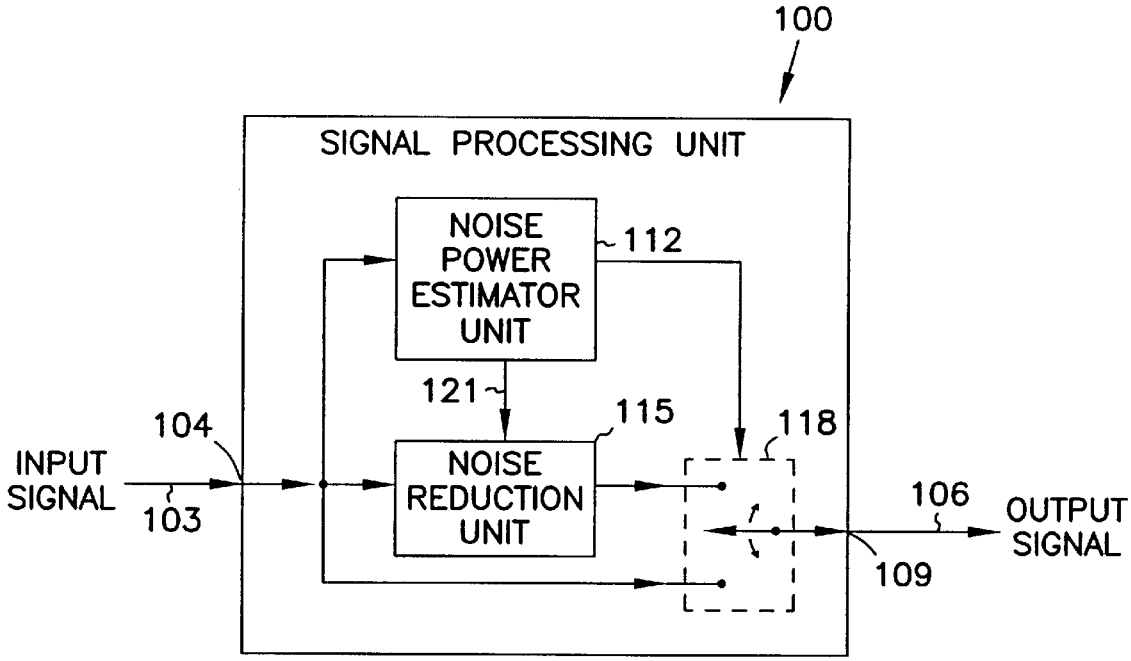
FIG. 1 is a block diagram of some embodiments of a signal processing unit of the present invention.

FIG. 1 is a block diagram of some embodiments of signal processing unit 100. Signal processing unit 100 receives input signal 103 at input connection 104 and processes input signal 103 to produce output signal 106 at output port 109. Signal processing unit 100 comprises noise power estimator unit 112, noise reduction unit 115, and selectable switch unit 118. Input signal 103 is operably coupled to noise power estimator unit 112, noise reduction unit 115, and to at least one of the plurality of the inputs of selectable switch unit 118. The output port of noise reduction unit 115 is operably coupled to at least one of the plurality of inputs of selectable switch unit 118. A first output port of noise power estimator unit 112 is operably coupled to the control input of selectable switch unit 118. An input port of noise power estimator unit 112 is operably coupled to noise reduction unit 115. The output port of selectable switch unit 118 is operably coupled to output port 109 and provides output signal 106 at output port 109.

Noise power estimator unit 112 processes input signal 103 to obtain a noise information signal 121, which includes a noise power estimate and a noise floor threshold value. Noise information signal 121 is provided to noise reduction unit 115 from the second output port of noise power estimator unit 112.

In one embodiment, for input signal 103 having a spectrum approximating the spectrum of a speech signal, noise power estimator unit 112 estimates the noise power of input signal 103 using a short time spectral amplitude estimation model. Noise power estimator unit 112 calculates the noise floor threshold (NFT) as follows:

$$NFT = \frac{1}{N}\sum_{i=0}^{M} \mathrm{MAX}(F_i(0), \ldots, F_i(M-1)).$$

In the equation shown above, N is the number of time frames over which the estimate is averaged. In one embodiment, N is sixty-two eight millisecond frames. Also, in the equation shown above, F(M) is the noise floor power estimate, and M is the number of frequency bins in each time slice, which is dependent on the fast fourier transform size. For example, the number of bins, M, in a one-hundred and twenty eight point fast fourier transform of input signal 103 is sixty-four. In an alternate embodiment, noise power estimator unit 112 calculates the noise floor threshold as the average noise power in input signal 103.

Figure 2:
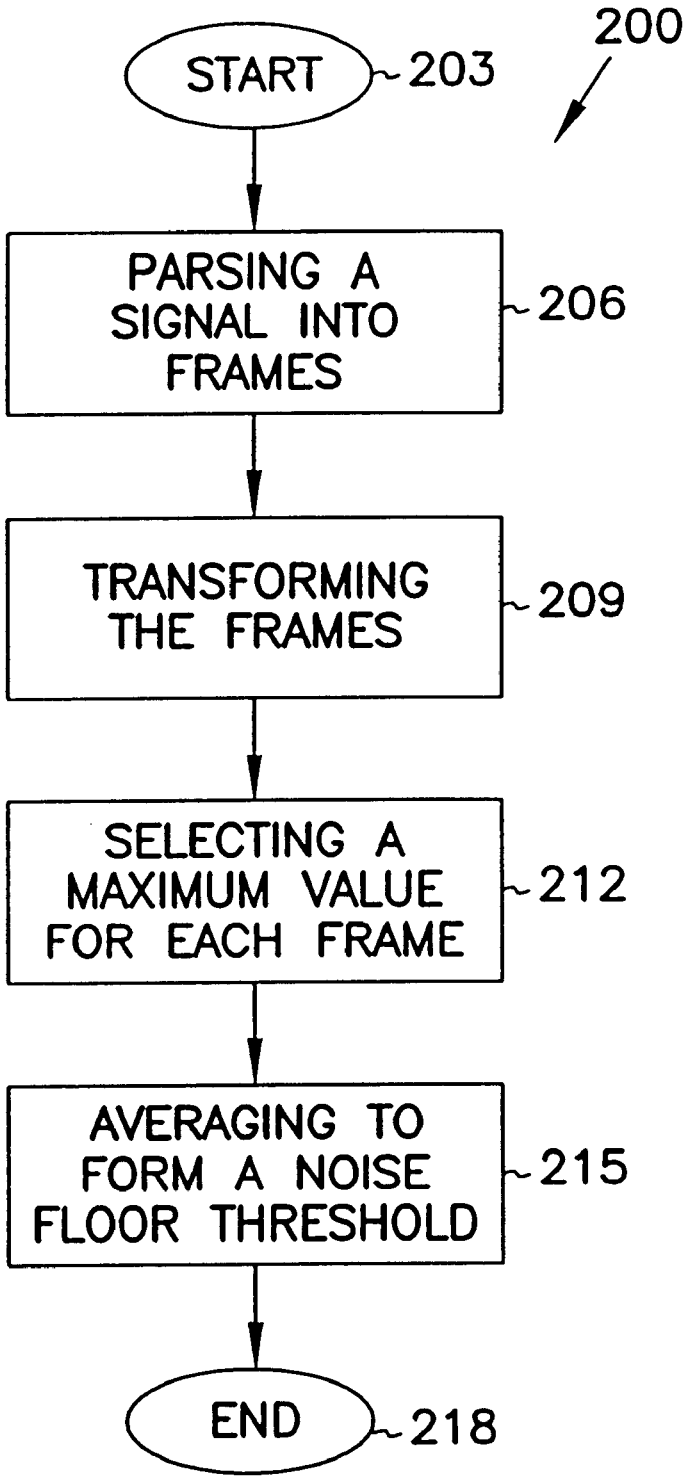
FIG. 2 is a flow diagram of some embodiments of a method of generating a noise floor threshold.

FIG. 2 is a flow diagram of some embodiments of method 200 of generating the noise floor threshold value described above. Method 200 begins at the start 203 operation, which is followed by the parsing 206 operation. At the parsing 206 operation, a signal is parsed into frames. In one embodiment, in processing a speech signal, the speech signal is parsed into sixty-two frames that are each eight milliseconds long. At the transforming 209 operation, a transform of each frame is computed. In one embodiment, the fourier transform of each frame is computed. At the selecting 212 operation a maximum noise floor value for each frame is selected from the transform of the frame. At the averaging 215 operation, the maximum noise floor values associated with the frames are averaged over the total number of frames to generate the noise floor threshold. In one embodiment, the maximum noise floor values associated with each of the sixty-two frames are averaged over the sixty-two frames to form the noise floor threshold value. Method 200 terminates at the end 218 operation.

Referring again to FIG. 1, noise reduction unit 115, in one embodiment, processes input signal 103 using a filter that attenuates frequencies outside the frequencies of interest contained in input signal 103. In an alternate embodiment, noise reduction unit 115 processes input signal 103 using a musical noise smoothing filter when speech is not present in input signal 103.

Switch unit 118 receives a plurality of inputs, and gates one of the plurality of inputs to output port 109. Switch unit 118, in one embodiment, receives input signal 103 and a noise reduced version of input signal 103 from noise reduction unit 115 and gates either the noise reduced signal or the input signal 103 to output port 109 in response to a control signal provided at an output port of noise power estimator unit 112.

Signal processing unit 100, in accordance with the present invention, receives input signal 103. Input signal 103 is utilized by noise reduction unit 115 to provide a noise reduced version of input signal 103 at the output port of noise reduction unit 115. Input signal 103 is also processed by noise power estimator unit 112 to provide to the control input of selectable switch unit 118 a control signal from the first output port of noise power estimator unit 112. The control signal provided by noise power estimator unit 112 causes selectable switch unit 118 to gate either input signal 103 or a noise reduced version of input signal 103, which is provided at the output port of noise reduction unit 115, to output port 109. If the noise power estimate is greater than a noise level threshold calculated in noise power estimator unit 112, then the noise reduced version of input signal 103 is gated to output port 109 If the noise power estimate is not greater than a noise level threshold, then the input signal 103 is gated to output port 109.

Figure 3:
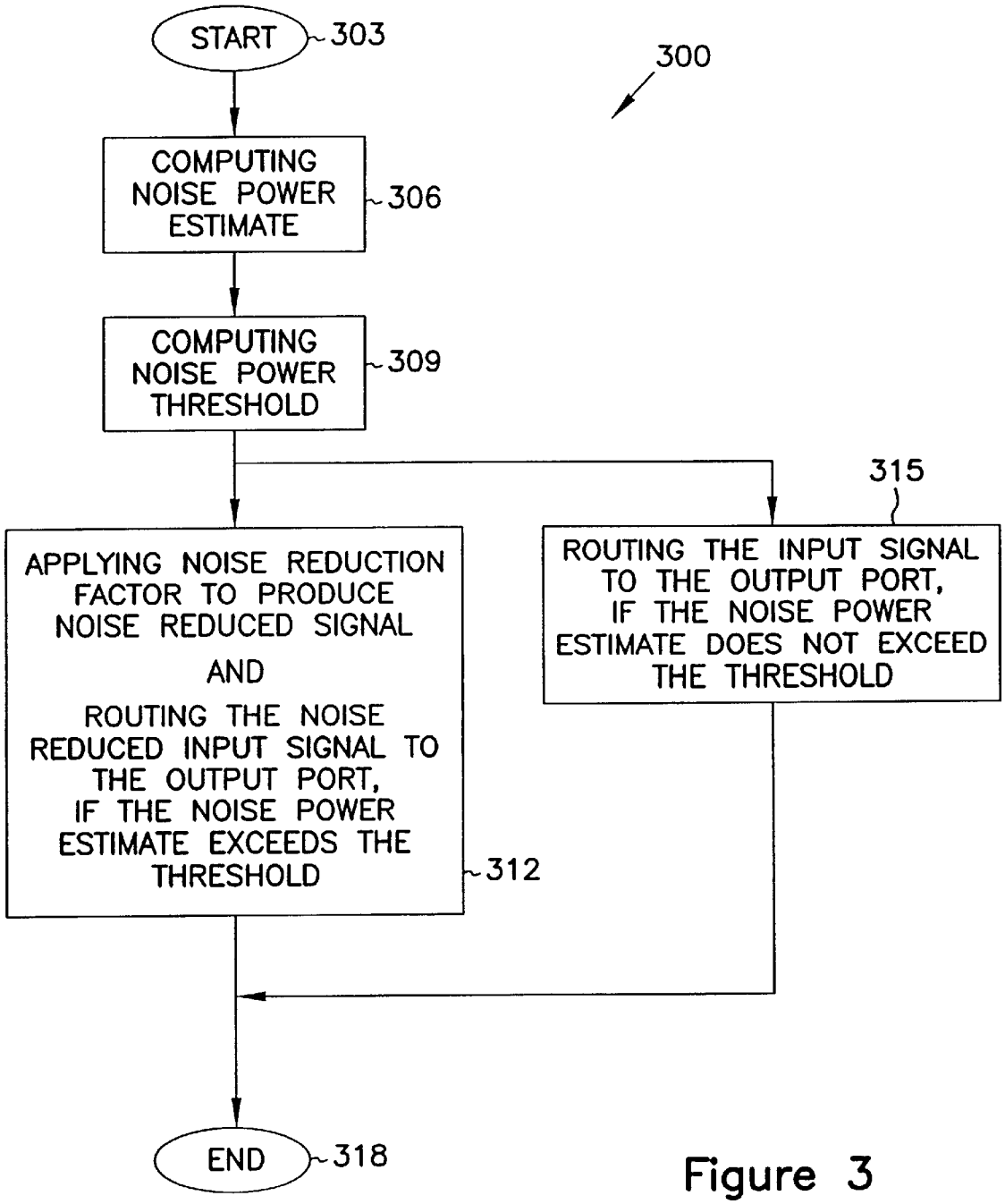
FIG. 3 is a flow diagram of some embodiments of a method of reducing the noise level in a noise corrupted signal.

FIG. 3 is a flow diagram of some embodiments of method 300 of reducing the noise level in a noise corrupted signal. Method 300 begins at the start 303 operation, which is followed by the computing 306 operation. At the computing 306 operation, a noise power estimate is computed, as described above. At the computing 309 operation, a noise power threshold value for an input signal is computed, as described above. At the applying and routing 312 operation, a noise reduction factor is applied to the input signal to produce a noise reduced signal, and a noise reduced input signal is routed to the output port, if the noise power estimate exceeds the noise power threshold value. In one embodiment, for a signal having a spectrum resembling that of a speech signal, a first noise reduction factor is applied to the input signal when speech is present on the input signal, and a second noise reduction factor is applied to the input signal when speech is not present on the input signal. At the routing 315 operation, the input signal is routed to the output port, if the noise power estimate does not exceed the threshold. The applying and routing 312 operation and the routing 315 operation terminate at the end 318 operation.

An advantage of signal processing unit 100 and noise reduction method 300 is that the threshold noise power level is set so that a low energy speech signal near the noise floor is not misinterpreted as noise. This allows signal processing unit 100 to avoid distorting the low energy speech signal through filtering, or some other noise reduction process.

Figure 4:
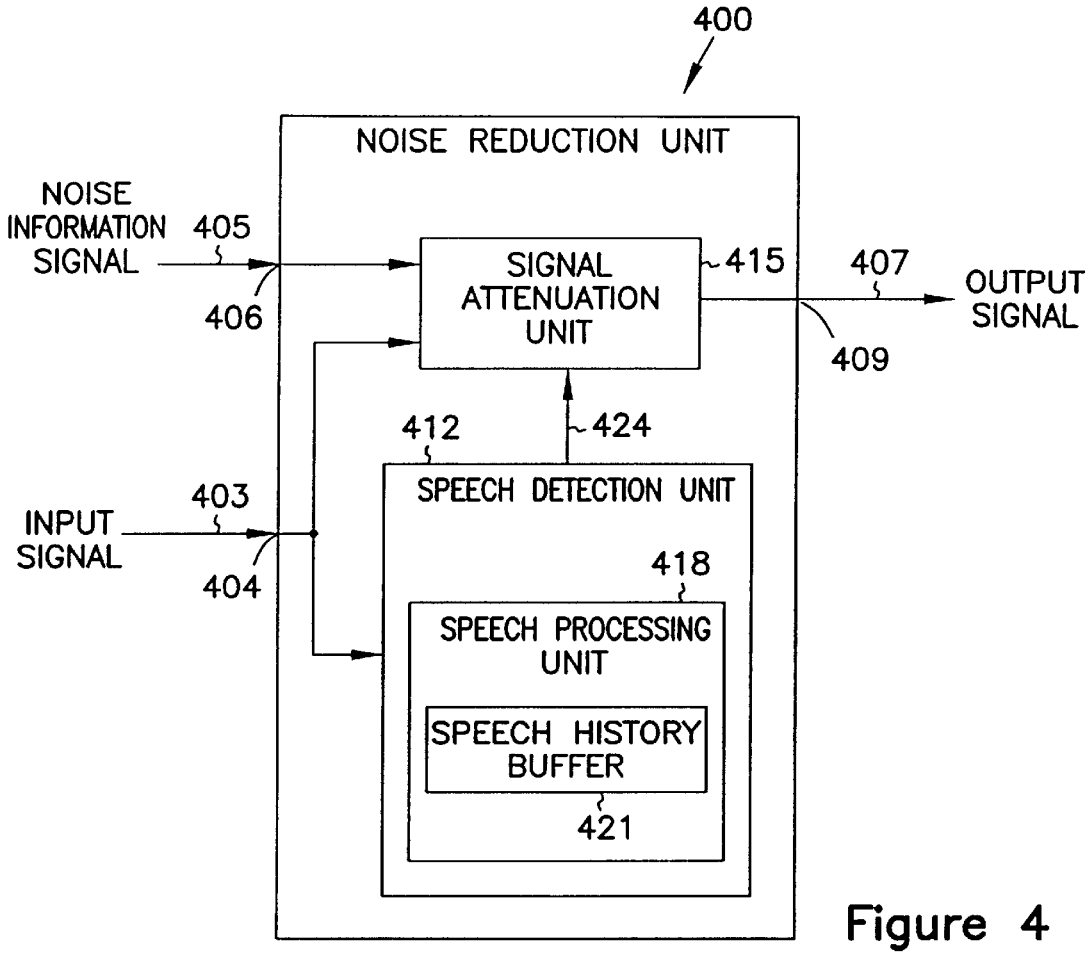
FIG. 4 is a block diagram of some embodiments of a noise reduction unit of FIG. 1.

FIG. 4 is a block diagram of some embodiments of noise reduction unit 400. The block diagram of noise reduction unit 400 is an expanded block diagram of noise reduction unit 115 of FIG. 1. Noise reduction unit 400 receives input signal 403 at input connection 404 and noise information signal 405, including a noise power estimate and a noise floor threshold value, at input connection 406. Noise reduction unit 400 processes input signal 403 and noise information signal 405 to produce output signal 407 at output port 409. Noise reduction unit 400 comprises speech detection unit 412 and signal attenuation unit 415. Speech detection unit 412 and signal attenuation unit 415 are operably coupled to input signal 403. Signal attenuation unit 415 is operably coupled to noise information signal 405 and to an output port of speech detection unit 412,which provides a speech detection signal to signal attenuation unit 415.

Speech detection unit 412 includes speech processing unit 418 and speech history buffer 421. Speech detection unit 412 processes input signal 403 to determine whether speech is present. In one embodiment, speech detection unit 412 analyzes the time domain speech signal to determine whether speech is present at a particular time. For example, samples of the amplitude of input signal 403 are examined to determine whether speech is present. In another embodiment, speech detection unit 412 analyzes the frequency domain signal to determine whether speech is present at a particular time. For example, the power level of the frequency components is examined to determine whether speech is present. In still another embodiment, speech detection unit 412 analyzes both the time domain signal and the frequency domain signal to determine whether speech is present in input signal 403. In any of the described embodiments, speech detection unit 412 generates a speech detection signal which is provided to signal attenuation unit 415.

Speech detection unit 412 includes speech processing unit 418 and speech history buffer 421. Speech detection unit 412 maintains speech history buffer 421 to improve the detection of speech. Speech detection unit 412 determines the maximum speech signal estimate along both the time history and the frequency history of the speech history buffer 421, and if the maximum speech estimate is greater than the current speech signal estimate, the attenuation factor is reduced using a weighted exponential window function. When speech is present on input signal 403, as indicated by speech detection signal 424, signal attenuation unit 415 applies a first attenuation factor to reduce the noise content of input signal 403. In one embodiment, the first attenuation factor is equal to $\delta$, which in one embodiment equals 0.75, times a current attenuation factor plus a quantity $(1-\delta)$ times a minimum attenuation factor.

Speech history buffer 421 maintains a time history and a frequency history of input signal 403. The time history, in one embodiment, includes a transform of twenty-five, eight millisecond frames over sixty-four frequency bins. The frequency history, in one embodiment, includes two previous frequency bins to the current frequency bin.

Signal attenuation unit 415 receives and attenuates input signal 403. In the process of attenuating input signal 403, signal attenuation unit 415 utilizes noise information signal 405 and speech detection signal 424. When speech is present on input signal 403, as indicated by the speech detection signal 424 provided by speech detection unit 412, signal attenuation unit 415 applies a first attenuation factor to reduce the noise in input signal 403. In one embodiment, the first attenuation factor is equal to $\delta$ times a current attenuation factor plus a quantity $(1-\delta)$ times a minimum attenuation factor. In one embodiment, $\delta$ is between 0.7 and 0.8. In an alternate embodiment, $\delta$ equals 0.75. When speech is not present on input signal 403, signal attenuation unit 415 applies a second attenuation factor to input signal 403. In one embodiment, the second attenuation factor is equal to $\beta$ times an attenuation factor from a previous frequency bin plus a quantity $(1-\beta)$ times a current attenuation factor. In one embodiment, β is between 0.8 and 1.0. In an alternate embodiment, β equals 0.9.

Noise reduction unit 400, in accordance with the present invention, receives input signal 403. In one embodiment, input signal 403 has the spectral characteristics of speech. Speech detection unit 412 receives input signal 403 and provides speech detection signal 424 to signal attenuation unit 415 to indicate whether speech is present on input signal 403. Signal attenuation unit 415 also receives input signal 403 and noise information signal 405 and generates output signal 406 at output port 409 in response to speech detection signal 424 provided by speech detection unit 515. If speech detection signal 424 indicates that speech is present, then signal attenuation unit 415 noise reduces input signal 403 by applying a first attenuation factor, as described above. If the speech detection signal indicates that speech is not present, then signal attenuation unit 415 applies a second attenuation factor to input signal 403, as described above.

An advantage of noise reduction unit 400 is that it reduces speech corrupting noise from input signal 403 when speech is present on input signal 403 and prevents musical noise from being introduced into output signal 407 when speech is not present on input signal 403.

Figure 5:
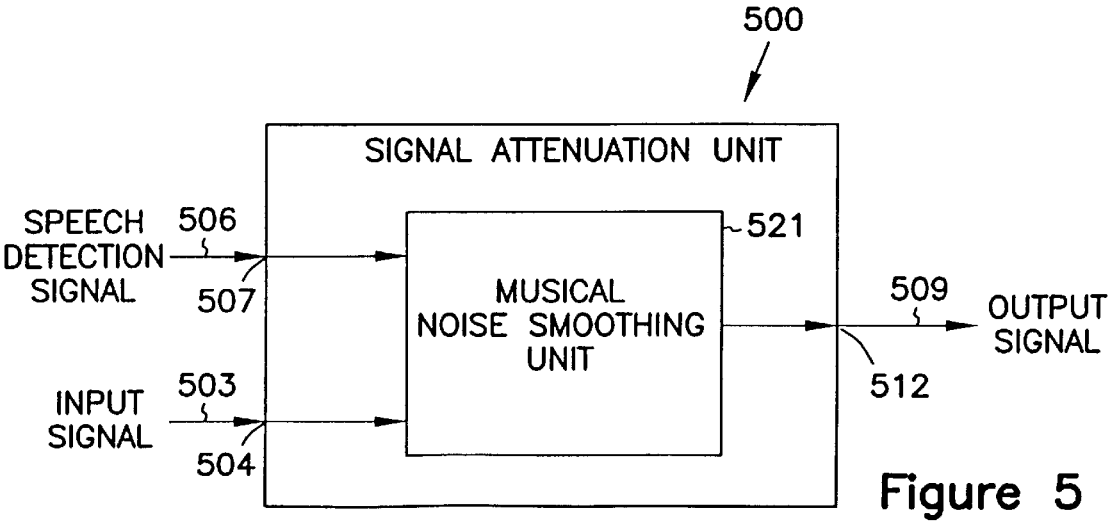
FIG. 5 is a block diagram of some embodiments of a signal attenuation unit of FIG. 4.

FIG. 5 is a block diagram of some embodiments of signal attenuation unit 500, which is an expanded block diagram of signal attenuation unit 415 of FIG. 4. Signal attenuation unit 500 receives input signal 503 at input connection 504 and speech detection signal 506 at input connection 507. Signal processing attenuation unit 500 processes input signal 503 and speech detection signal 506 to provide output signal 509 at signal attenuation unit output port 512. Signal attenuation unit 500 comprises musical noise smoothing unit 521. Musical noise smoothing unit 521 is operably coupled to input signal 503 and to speech detection signal 506. Output port 512 is operably coupled to the output port of musical noise smoothing unit 521.

Musical noise smoothing unit 521 reduces musical or watery noise, in the absence of speech. Musical or watery noise is usually associated with spectral subtraction algorithms. One explanation for this artifact is that the structure of the noise floor is damaged, which results in isolated tones in the signal spectrum. To reduce the effect of this artifact, musical noise smoothing unit 521 receives input signal 503 and speech detection signal 506. If speech detection signal 506 indicates an absence of speech, then musical noise smoothing unit 521 applies an exponential window smoothing function along the frequency axis. In one embodiment, the attenuation factor is equal to β, which in one embodiment equals 0.9 times an attenuation factor from a previous frequency bin plus a quantity (1−β) times a current attenuation factor.

One advantage of processing input signal 503 using signal attenuation unit 500 is the mitigation of musical noise in the output signal. A second advantage is that for trailing or low energy speech near the noise floor, reducing the attenuation factor improves the signal-to-noise ratio in output signal 509 by about 6 dB when compared with signals processed in systems not employing signal attenuation unit 500. A third advantage is that low energy speech is retained even while musical noise is mitigated.

Figure 6:
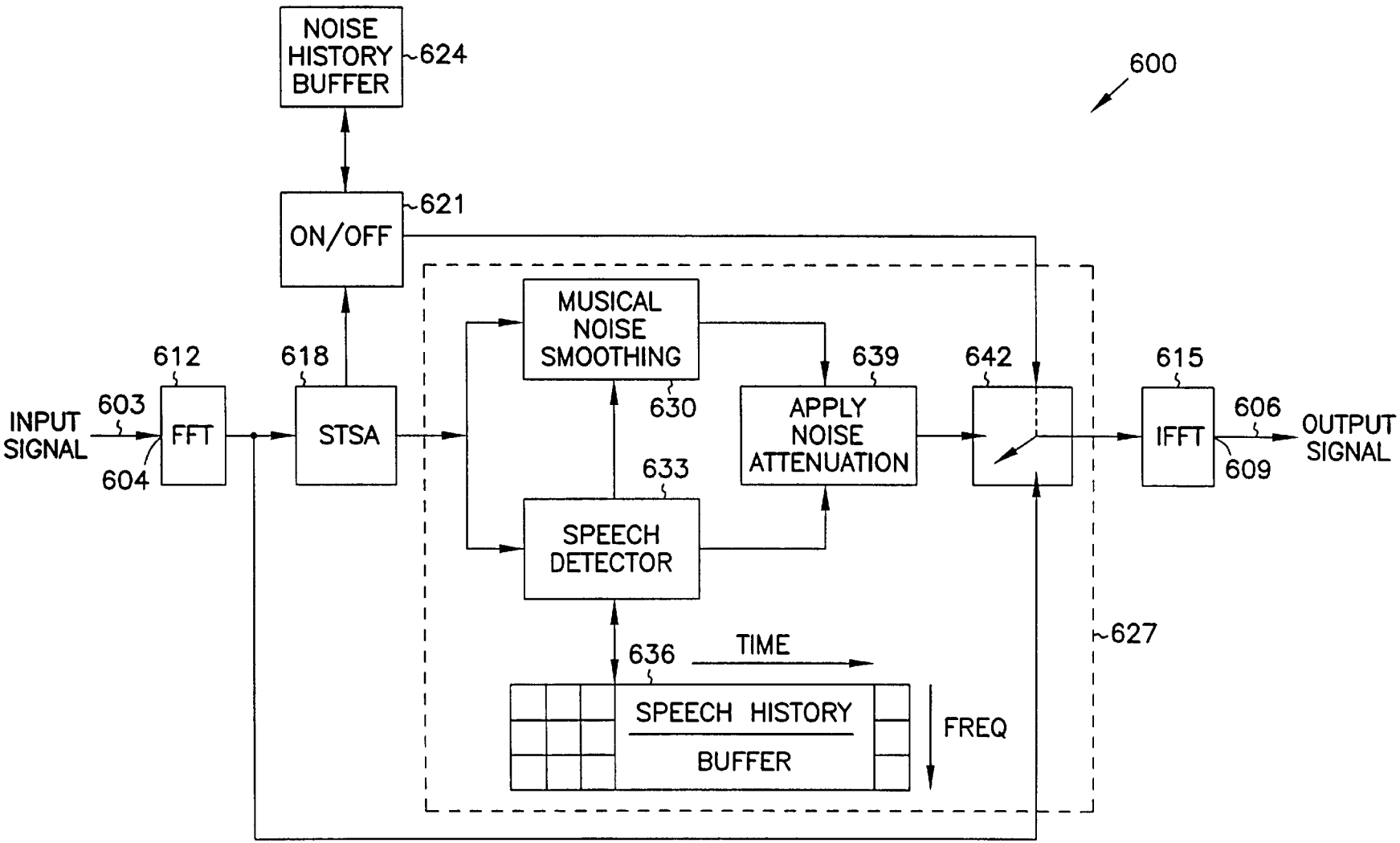
FIG. 6 is a block diagram of some embodiments of a signal processing and noise reduction system of the present invention.

FIG. 6 is a block diagram of some embodiments of signal processing and noise reduction system 600. System 600 receives input signal 603 at input connection 604 and processes input signal 603 to provide output signal 606 at output port 609. System 600 comprises fast fourier transform (FFT) unit 612, inverse fast fourier transform (IFFT) unit 615, short time spectral amplitude (STSA) unit 618, ON/OFF unit 621, noise history buffer 624, and noise reduction unit 627. Noise reduction unit 627 is operatively coupled to FFT unit 612, IFFT unit 615, STSA unit 618, and ON/OFF unit 621. Additionally, STSA unit 618 is operatively coupled to FFT 612 and ON/OFF unit 621, and ON/OFF unit 612 is operatively coupled to noise history buffer 624. FFT 612 receives input signal 603, and STSA unit 618, ON/OFF unit 621, noise history buffer 624, noise reduction unit 627, and IFFT 615 process the FFT of input signal 603 to produce output signal 606 at output port 609 of IFFT 615.

Noise reduction unit 627 includes musical noise smoothing unit 630, speech detector 633, speech history buffer 636, apply noise attenuation unit 639, and selectable switch unit 642. Musical noise smoothing unit 630 and speech detector 633 are operably coupled to STSA unit 618 and apply noise attenuation unit 639. Speech detector unit 633 is also operatively coupled to musical noise smoothing unit 630 and speech history buffer 636. Selectable switch unit 642 is operatively coupled to ON/OFF unit 621, apply noise attenuation unit 639, FFT unit 612, and IFFT unit 615.

FFT 612 converts time domain in put signal 603 into a frequency domain representation. In one embodiment, data is sampled at 8 kilohertz in 128 sample chunks, or 16 millisecond frames. FFT 612 transforms the one-hundred and twenty-eight samples of each 16 millisecond frame into a fourier transform of the frame.

STSA unit 618 applies an estimation model that processes the fourier transform of the frames that make up input signal 603 to obtain an attenuation factor for each frequency bin associated with each frame. U.S. Pat. No. 5,768,473, Adaptive Speech Filter and Ephraim Y., Malah D., "Speech Enhancement Using a Minimum Mean-Square Error Short-Time Spectral Amplitude Estimator", IEEE Transactions on Acoustics, Speech and Signal Processing, vol. ASSP-32, No. 6, December 1984 describe systems and methods for performing this function and is hereby incorporated by reference. Noise power estimates are communicated from the STSA model to ON/OFF unit 621 decision logic which controls selectable switch unit 642 that selects a noise reduced signal or a signal that is not noise reduced. In addition to calculating attenuation factors, STSA 618 calculates and stores in noise history buffer 624 the power levels of the noise in each frequency bin.

ON/OFF unit 621 controls selectable switch unit 642. If the noise power level calculated in STSA unit 618 does not exceed a noise power level threshold, then the output port of FFT unit 612 is gated by selectable switch unit 642 to IFFT 615, and no noise reduction is performed on input signal 603. If the noise power level calculated in STSA unit 618 does exceed a noise power level threshold, then output port of apply noise attenuation 639 is gated to IFFT 615, and noise is reduced in input signal 603.

Noise reduction unit 627 receives inputs from STSA unit 618 and continuously generates a noise reduced signal at the output port of apply noise attenuation unit 639. As described above, only when the noise power of input signal 603 exceeds a threshold level is the noise reduced signal at the output port of apply noise attenuation unit 639 gated to IFFT 615.

Musical noise smoothing 630 reduces musical noise in the signal received from STSA unit 618 when speech is not present on the received signal. The operation of musical noise smoothing unit 620 is described above in connection with FIG. 5 noise smoothing unit 521.

Speech detector 633 in cooperation with speech history buffer 636 identifies speech in input signal 603. Speech detector 633 and speech history buffer 636 are described above as speech detection unit 412 and speech history buffer 421 in connection with FIG. 5.

Apply noise attenuation unit 639 applies a modified gain to smooth the musical noise when speech is not present. When speech is present, apply noise attenuation unit 639 applies an STSA computed gain to suppress the noise embedded in the speech signal.

Figure 7:
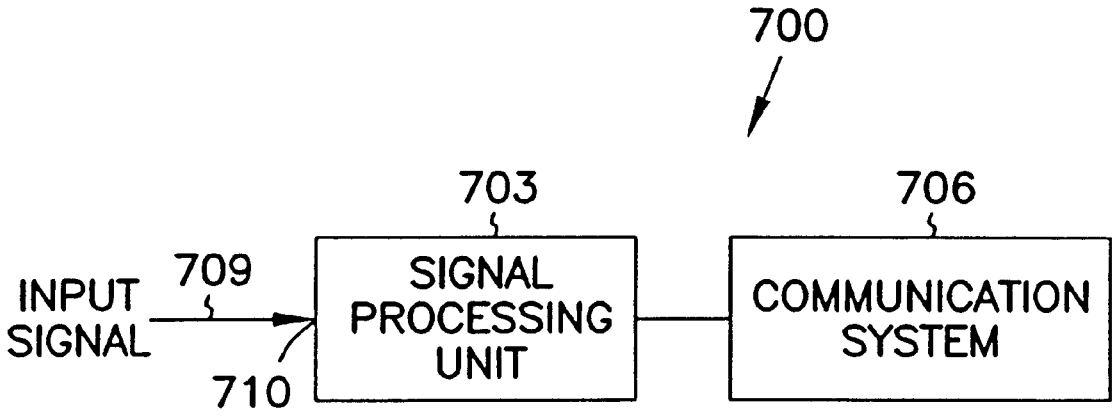
FIG. 7 is a block diagram of some embodiments of a noise reduced communication system of the present invention.

FIG. 7 is a block diagram of some embodiments of noise reduced communication system 700 of the present invention. System 700 comprises input processing unit 703 operably coupled to communication system 706. Signal processing unit 703 is suitable for use in connection with a variety of communication systems. Input processing unit 703 receives input signal 709 at input connection 710, processes input signal 709, as described above, and transmits the processed signal to communication system 706. In one embodiment, communication system 706 is a conferencing system. In an alternate embodiment, communication system 706 is a phone system.

Although specific embodiments have been illustrated and described herein, it will be appreciated by those of skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. An apparatus comprising:

a signal processing unit having an output port and operable for selectively routing an unfiltered input signal and a noise reduced version of the unfiltered input signal to the output port in response to a signal derived from a noise power estimate, wherein the input signal has an average noise power and the signal derived from the noise power estimate is derived from a comparison of a noise floor threshold, which is the average noise power, to the noise power estimate, wherein the noise floor threshold (NFI) is calculated as follows:

$$NFT = \frac{1}{N}\sum_{i=0}^{M}\mathrm{MAX}(F_i(0), \ldots, F_i(M-1)),$$

wherein N is a number of time frames over which an estimate is averaged, M is a number of bins in each time slice, and F(M) is a noise floor power estimate for bin M.

2. An apparatus comprising:

a signal processing unit having an output port and operable for selectively routing an unfiltered input signal and a noise reduced version of the unfiltered input signal to the output port in response to a signal derived from a noise power estimate, wherein the input signal is a speech signal and a first filter is applied to the input signal when speech is present in the input signal and a second filter is applied to the input signal when speech is not present in the input signal to form the noise reduced version of the input signal, and wherein the second filter is a musical noise smoothing filter.

3. A signal processing unit having an output port, the signal processing unit comprising:

a noise power estimator unit having a noise power estimator output port and a noise power estimator output signal, and operable for receiving an input signal;

a noise reduction unit having an output port and operably coupled to the input signal and capable of generating a noise reduced output signal; and a switch unit operably coupled to the input signal, the noise reduced output signal, and the noise power estimator output signal and capable of selectively routing the input signal, which is unfiltered, and the noise reduced output signal to the output port in response to the noise power estimator output signal, wherein the input signal is a speech signal, and wherein noise reduction is applied to the input signal during a time when speech is present in the speech signal, and wherein musical noise smoothing is applied to the input signal during a time when speech is not present in the speech signal.

4. A noise reduction unit comprising:

a signal processing unit operable for identifying a time period when speech is present in a signal and capable of attenuating the signal by a first attenuation factor during the time period when speech is present in the signal and attenuating the signal by a second attenuation factor during the time period when speech is not present in the signal, wherein the first attenuation factor is equal to a $\delta$ times a current attenuation factor plus a quantity $(1-\delta)$ times a minimum.

5. The noise reduction unit of claim 4, wherein $\delta$ is between about 0.7 and 0.8.

6. A noise reduction unit comprising:

a signal processing unit operable for identifying a time period when speech is present in a signal and capable of attenuating the signal by a first attenuation factor during the time period when speech is present in the signal and attenuating the signal by a second attenuation factor during the time period when speech is not present in the signal, wherein the second attenuation factor is equal to a $\beta$ times an attenuation factor from a previous frequency bin plus a quantity $(1-\beta)$ times a current attenuation factor.

7. The noise reduction unit of claim 6, wherein $\beta$ is between about 0.8 and 1.0.

8. A speech detection unit comprising:

a speech history buffer having a plurality of values; and a processing unit operably coupled to the speech history buffer and capable of identifying speech in an input signal in response to the plurality of values, wherein the speech history buffer is twenty-five frames.

9. The speech detection unit of claim 8, wherein the frequency history buffer is two frequency bins.

10. A method comprising:

identifying a maximum value in a plurality of values in a time history buffer and a frequency history buffer;

comparing the maximum value to a current speech signal estimate; and reducing an attenuation factor, if the maximum value exceeds the current speech signal estimate, wherein reducing an attenuation factor, if the maximum value exceeds the current speech signal estimate comprises:

recomputing the attenuation factor as a function of a weighting factor, a current attenuation factor, and a minimum attenuation factor.

11. A method comprising:

parsing a signal into a plurality of frames;

transforming each of the plurality of frames to form a plurality of values associated with each of the plurality of frames;

selecting a maximum value for each frame from the plurality of values associated with each of the plurality of frames to form a plurality of maximum values; and averaging the plurality of maximum values to form a noise floor threshold.

12. The method of claim 11, wherein parsing the signal into the plurality of frames comprises:

identifying a sequence of sixty-two eight millisecond frames in the signal; and parsing the sequence of sixty-two eight millisecond frames.

13. The method of claim 12, wherein transforming each of the plurality of frames to form the plurality of values associated with each of the plurality of frames comprises:

applying a fourier transform to each of the plurality of frames to form the plurality of values associated with each of the plurality of frames.

* * * * *